US007528778B1

(12) United States Patent
Lynch

(10) Patent No.: US 7,528,778 B1
(45) Date of Patent: May 5, 2009

(54) STRUCTURE FOR COUPLING POWER

(75) Inventor: Jonathan J. Lynch, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 358 days.

(21) Appl. No.: 11/347,707

(22) Filed: Feb. 3, 2006

(51) Int. Cl.
*H01Q 1/38* (2006.01)
*H01Q 21/00* (2006.01)
*H01Q 15/02* (2006.01)

(52) U.S. Cl. ..... 343/700 MS; 343/893; 343/909

(58) Field of Classification Search ..... 343/700 MS, 343/853, 893, 895, 909
See application file for complete search history.

(56) References Cited

U.S. PATENT DOCUMENTS 4,203,116 A * 5/1980 Lewin ..... 343/700 MS
6,084,552 A * 7/2000 Robertson et al. ..... 343/753
6,927,737 B2 * 8/2005 Inoue ..... 343/727
7,023,386 B2 * 4/2006 Habib et al. ..... 343/700 MS
7,084,827 B1 * 8/2006 Strange et al. ..... 343/795

OTHER PUBLICATIONS

Mink, J.W., et al., "Quasi-optical power combining of solid state milimeter wave sources", *IEEE Trans. Microwave Theory Tech.*, vol. MTT-34, pp. 273-279 (Feb. 1986).
Popovic, Z.B., et al., "Grid Oscillators", *Int. J. Infrared Millimeter Waves*, vol. 9, No. 7, pp. 647-654 (1988).
Lynch, J.J., et al., "Modeling Polarization Mode Coupling in Frequency Selective Services," IEEE Transactions on Microwave Theory and Techniques, vol. 52, No. 4 pp. 1328-1338 (Apr. 2004).

* cited by examiner

*Primary Examiner*—Shin-Chao Chen
(74) *Attorney, Agent, or Firm*—Ladas & Parry LLP

(57) ABSTRACT

Structures and a method of manufacturing an oscillator are disclosed. The structure contains a substrate with a first and a second major surfaces, a first plurality of conductors arranged in a first pattern on the first major surface, and a second plurality of conductors arranged in a second pattern on the second major surface at a first angle to said first plurality of conductors to reflect and transmit incoming RF energy in cross polarization to a polarization of said incoming RF energy. The method disclosed teaches how to manufacture an oscillator using the structure.

23 Claims, 21 Drawing Sheets

STRUCTURE FOR COUPLING POWER

CROSS REFERENCE TO RELATED APPLICATIONS

This application is related to co-pending application U.S. application Ser. No., 11/247,709, filed on the same date as the present application, for "An Electromagnetic Array Structure Capable of Operating as An Amplifier or an Oscilator" by Jonathan Lynch, the disclosure of which is incorporated herein by reference. This application is related to co-pending application U.S. application Ser. No. 10/664,112, filed on Sep. 17, 2003, for "Bias Line decoupling method for monolithic amplifier arrays" by Jonathan Lynch, the disclosure of which is incorporated herein by reference.

FIELD OF THE INVENTION

This technology relates to structures for coupling power into and out of a quasi-optical structure.

BACKGROUND AND PRIOR ART

Power is difficult to produce at millimeter wave frequencies due to the low power output of transistors and the losses incurred by traditional power combiners at these frequencies. Free space combining, also called "quasi-optical" combining, eliminates the latter problem by allowing electromagnetic energy to combine in free space.

Quasi-optical arrays can provide high power by combining the outputs of many (e.g. thousands) of elements. Reflection amplifier arrays are a convenient way to produce power quasi-optically. The reflection amplifier arrays typically have orthogonally polarized input and output antennas in order to reduce mutual coupling between amplifier inputs and outputs. It is desirable to couple inputs and outputs together solely through a partial reflector in order to control the amplitude and phase delay of the coupled energy. Too much "parasitic" coupling between input and output alters the phases of the oscillators, causing decreased combining efficiency and potentially loss of synchronization.

Quasi-optical sources (oscillators) have been developed for millimeter wave power, and consist of a number of individual oscillators that are coupled together so that they mutually synchronize in phase and the radiation from all the elements combines coherently, typically in a (more or less) gaussian mode in front of the oscillator array. A number of different methods exist to realize the coupling network, from printed circuit transmission lines to partial reflectors. The key is to provide strong coupling between elements to ensure in-phase oscillation.

Many embodiments of oscillator arrays utilize "grid" amplifiers in a resonant cavity formed by a ground plane and a partial reflector. In this type of array the grid amplifiers have equal input and output polarizations so that polarization conversion at the partial reflector is not necessary. The drawback with this type of array is that it is difficult to optimize the efficiency since the grid amplifiers themselves are generally not impedance matched and driven under optimal conditions.

Most embodiments in the literature describe arrays that are "transmissive" and not reflective. See for example, J. W. Mink, "Quasi-optical power combining of solid state millimeter wave sources," IEEE Trans. Microwave Theory Tech., vol. MTT-34, pp. 273-279, Feb. 1986 and Z. B. Popovic, M. Kim, and D. B. Rutledge, "Grid oscillators," Int. J. Infrared Millimeter Waves, vol. 9, no. 7, pp. 647-654, 1988. This is primarily due to ease of measurements for the transmissive arrays—reflect array performance is difficult to measure since both the source and the load are collocated. However, reflect arrays have the very important advantage of being able to be directly bonded to a heat sink. This is very important for large arrays at millimeter wave frequencies, where efficiency drops considerably and the number of devices per unit area is high.

According to the present disclosure, embodiments of structures are described that collimate both the reflected and transmitted energy, and couples all of the reflected power into the orthogonal polarization, as required by the reflection amplifier array.

SUMMARY

According to the present disclosure, structures for coupling power into and out of a quasi-optical structure are disclosed.

According to a first embodiment, a structure is disclosed, comprising: a substrate, a first plurality of periodic pattern of conductors being supported by a first major surface of said substrate, a second plurality of periodic pattern of conductors being supported by a second major surface of said substrate, wherein said first plurality of periodic pattern of conductors are at a first angle to said second plurality of periodic pattern of conductors and said first and second plurality of periodic pattern of conductors reflect and transmit an incoming RF energy in cross polarization compared to a polarization of said incoming RF energy.

According to a second embodiment, an electromagnetic array structure is disclosed, comprising: a plurality of active amplification devices arranged in an array, wherein an input of each active amplification device is cross polarized with respect to an output of each active amplification device, a structure disposed in a spaced relation with the plurality of active amplification devices, wherein said structure contains a substrate and a first and second plurality of periodic pattern of conductors and said structure couples cross polarized input and output of each active amplification device so as to only reflect power in the same polarization as polarization of said input of each active amplification device.

According to a third embodiment, a structure is disclosed, comprising: a plurality of metal ribs connected by a frame adapted to reflect and transmit an incoming RF energy in cross polarization.

According to a fourth embodiment, an electromagnetic array structure is disclosed, comprising: a plurality of active amplification devices arranged in an array, wherein an input of each active amplification device is cross polarized with respect to an output of each active amplification device, a structure disposed in a spaced relation with the plurality of active amplification devices, wherein said structure contains a plurality of metal ribs and said structure couples cross polarized input and output of each active amplification device so as to only reflect power in the same polarization as polarization of said input of each active amplification device.

According to a fifth embodiment, a method for manufacturing an oscillator is disclosed, comprising: disposing a plurality of active amplification devices in an array, wherein an input of each active amplification device is cross polarized with respect to an output of each active amplification device, disposing a structure in a spaced relation with the plurality of active amplification devices so as to couple cross polarized input and output of each active amplification device, wherein said structure comprises a substrate, a first plurality of periodic pattern of conductors disposed on said first major surface of said substrate, a second plurality of periodic pattern of conductors disposed on said second major surface of said substrate, wherein said first plurality of periodic pattern of conductors are at a first angle to said second plurality of periodic pattern of conductors.

According to a sixth embodiment, a method for manufacturing an oscillator is disclosed, comprising: arranging a plurality of active amplification devices in to an array, wherein an input of each active amplification device is cross polarized with respect to an output of each active amplification device, providing a structure in a spaced relation with the plurality of active amplification devices so as to couple cross polarized input and output of each active amplification device, wherein said structure comprises a plurality of metal ribs.

According to a seventh embodiment, a structure is disclosed, comprising: a frequency selective surface which retransmits an incoming RF energy in a predetermined frequency range and also partially reflects said incoming RF energy in said predetermined frequency range, the reflected and retransmitted RF energies having an orthogonal polarization compared to polarization of said incoming RF energy.

BRIEF DESCRIPTION OF THE FIGURES AND THE DRAWINGS

Figure 2:
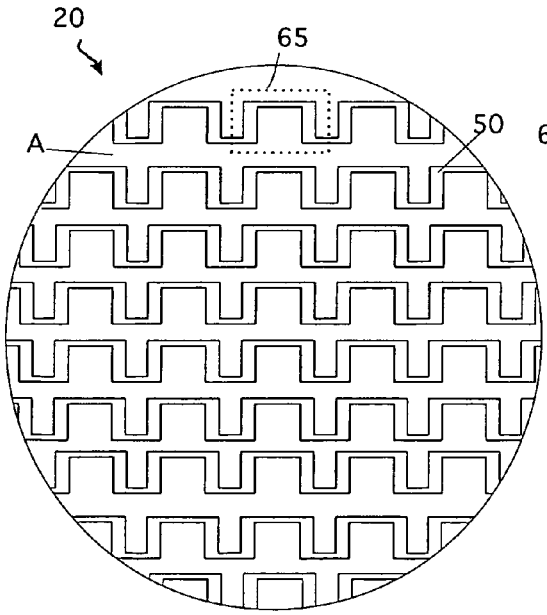
FIG. 2 depicts a top view of side A of the FSS depicted in FIG. 1 in accordance with the present disclosure.
Figure 3:
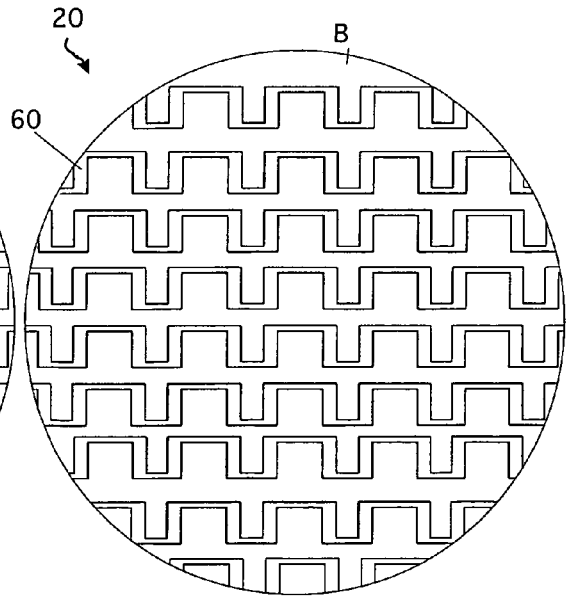
FIG. 3 depicts a top view of side B of the FSS depicted in FIG. 1 in accordance with the present disclosure.
Figure 8A:
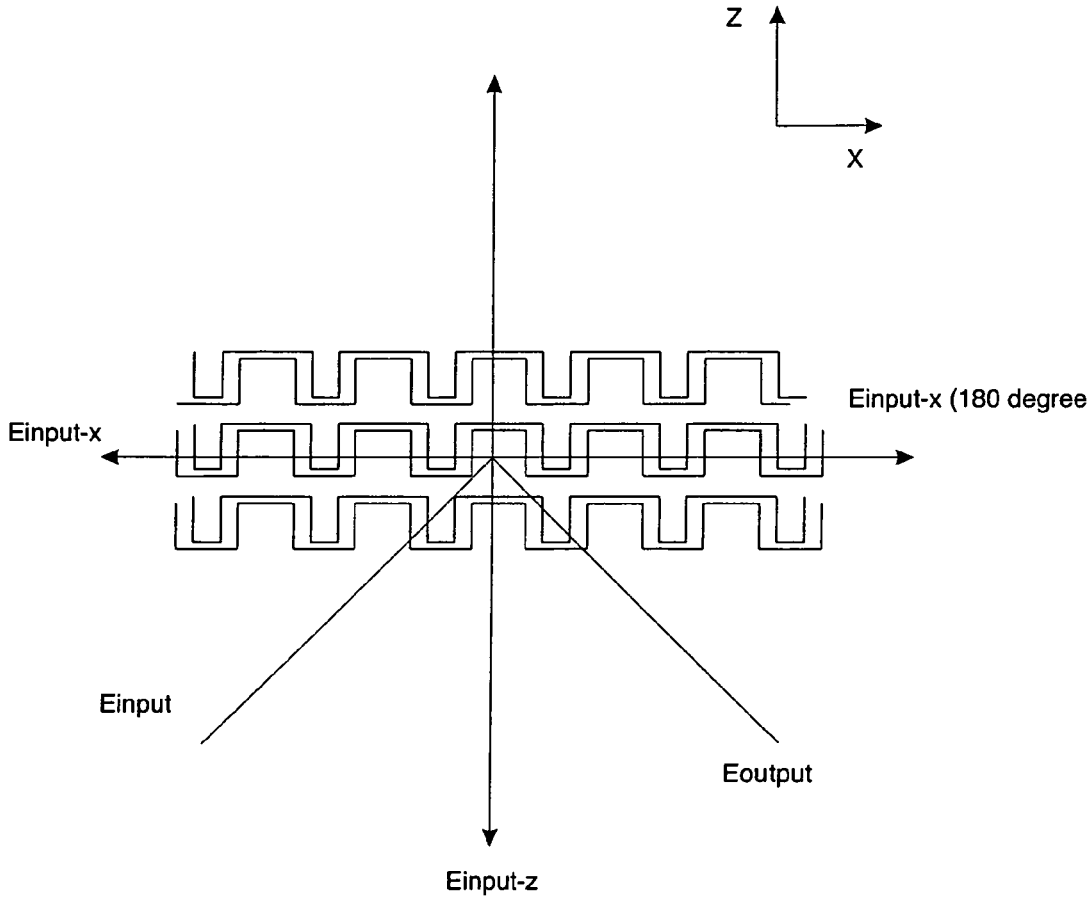
Figure 8B:
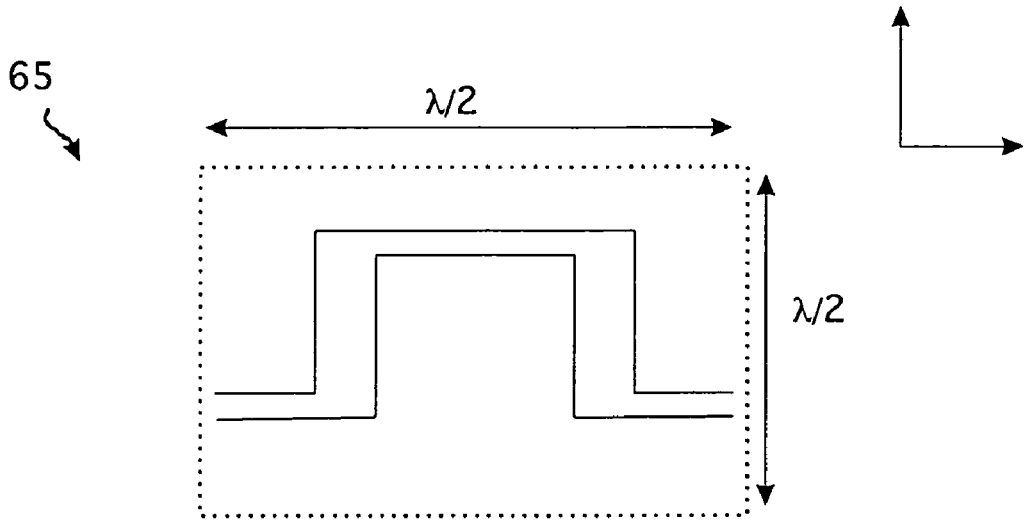
Figure 8C:
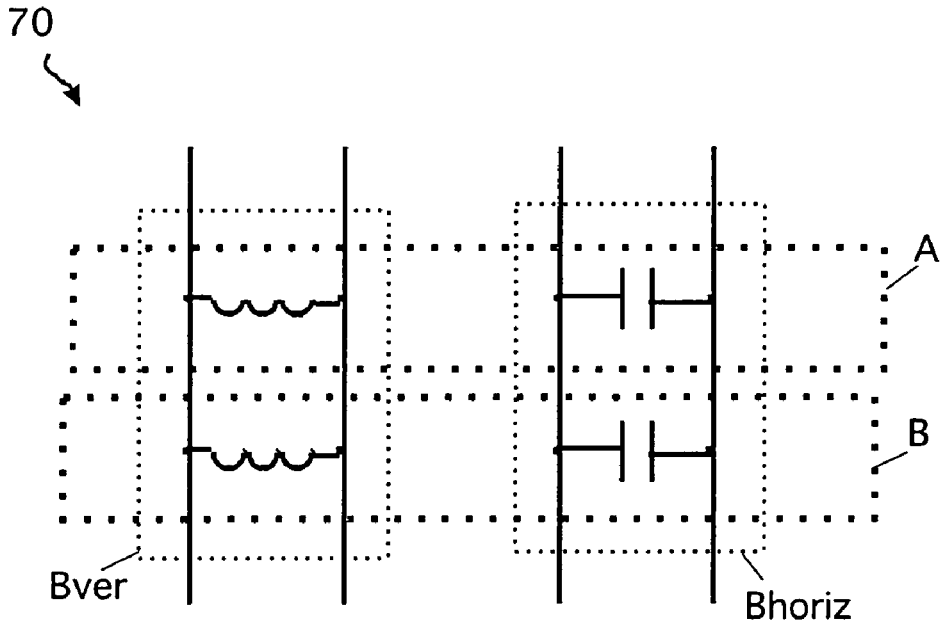
Figure 9A:
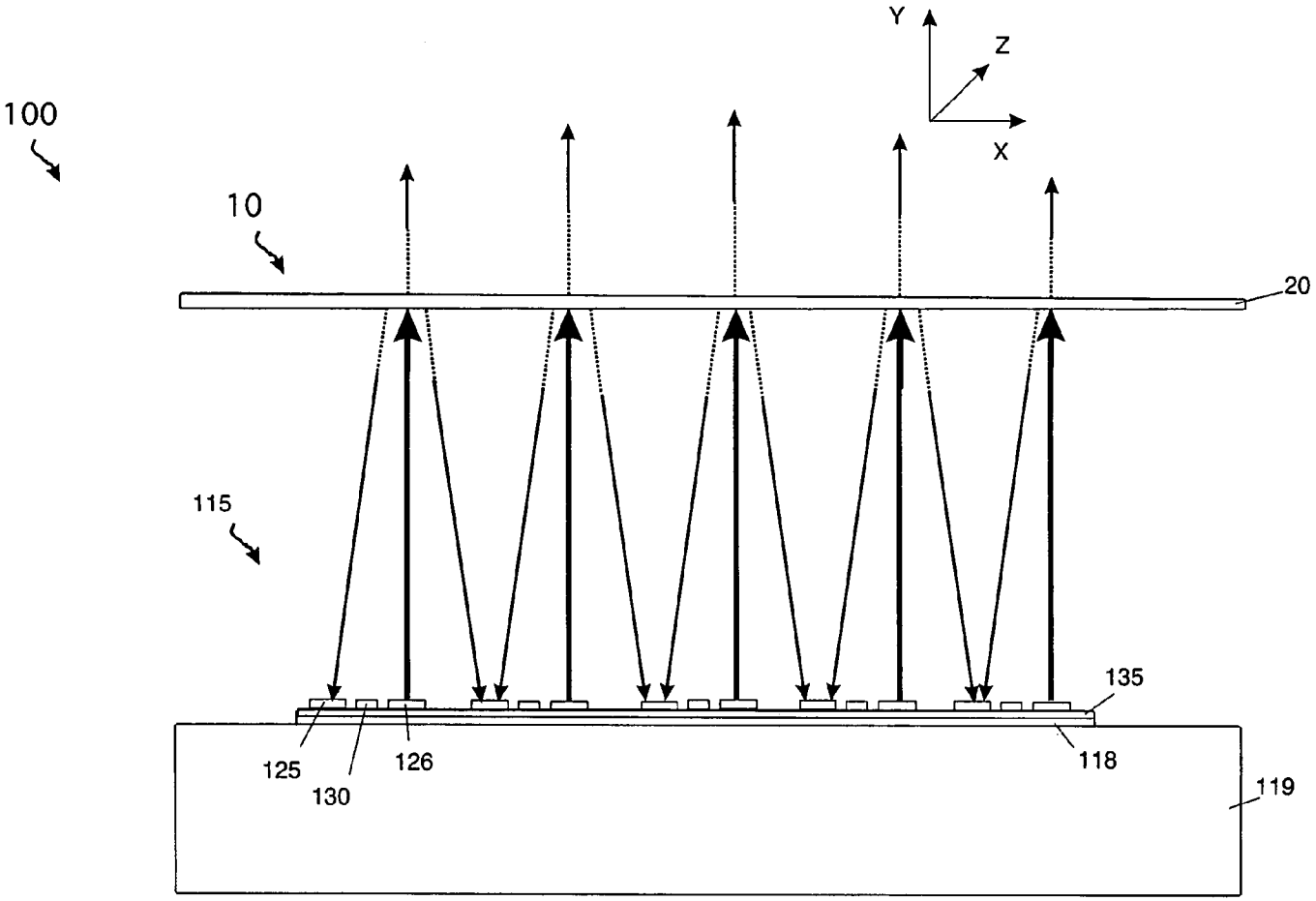
Figure 9B:
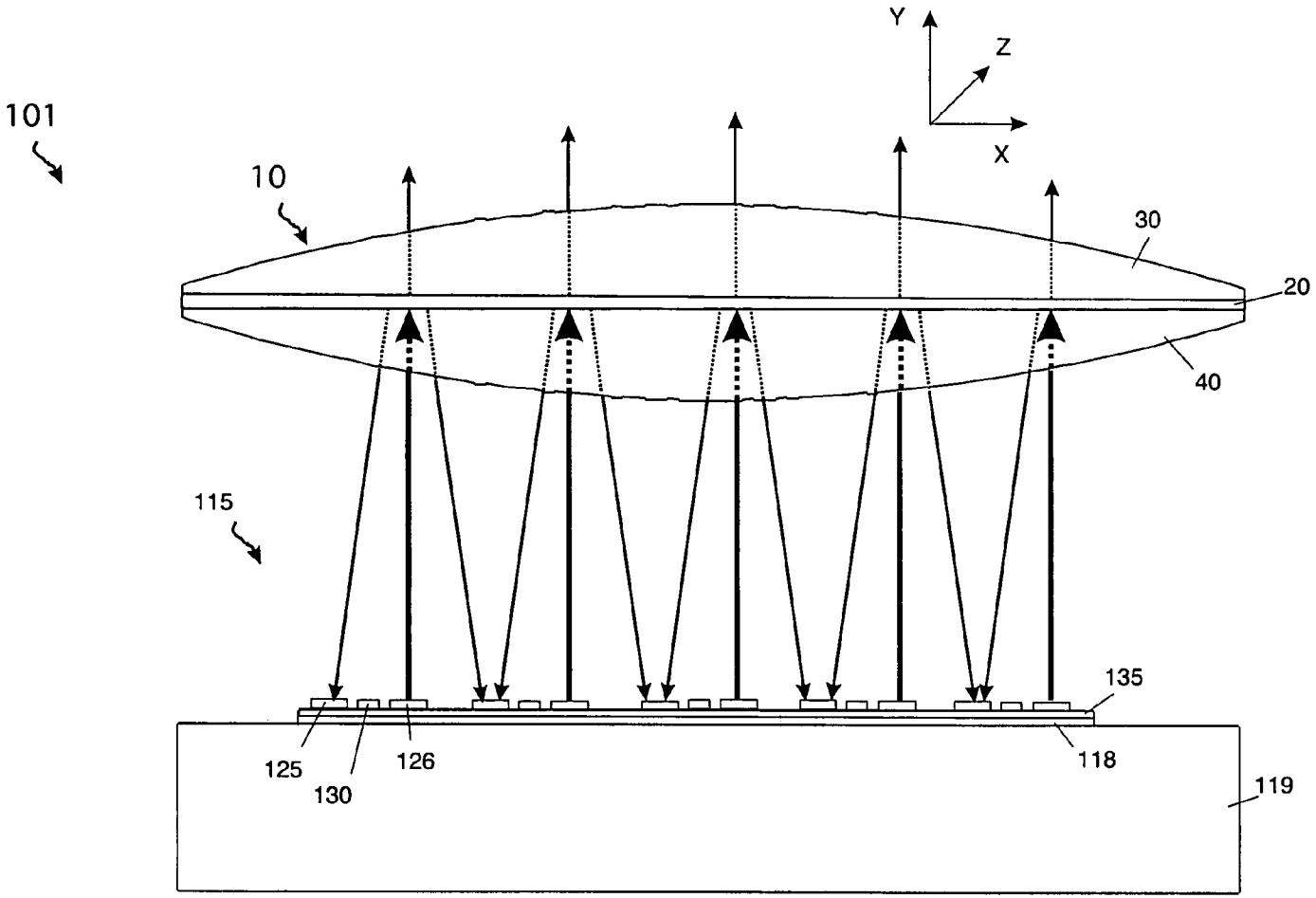
Figure 10:
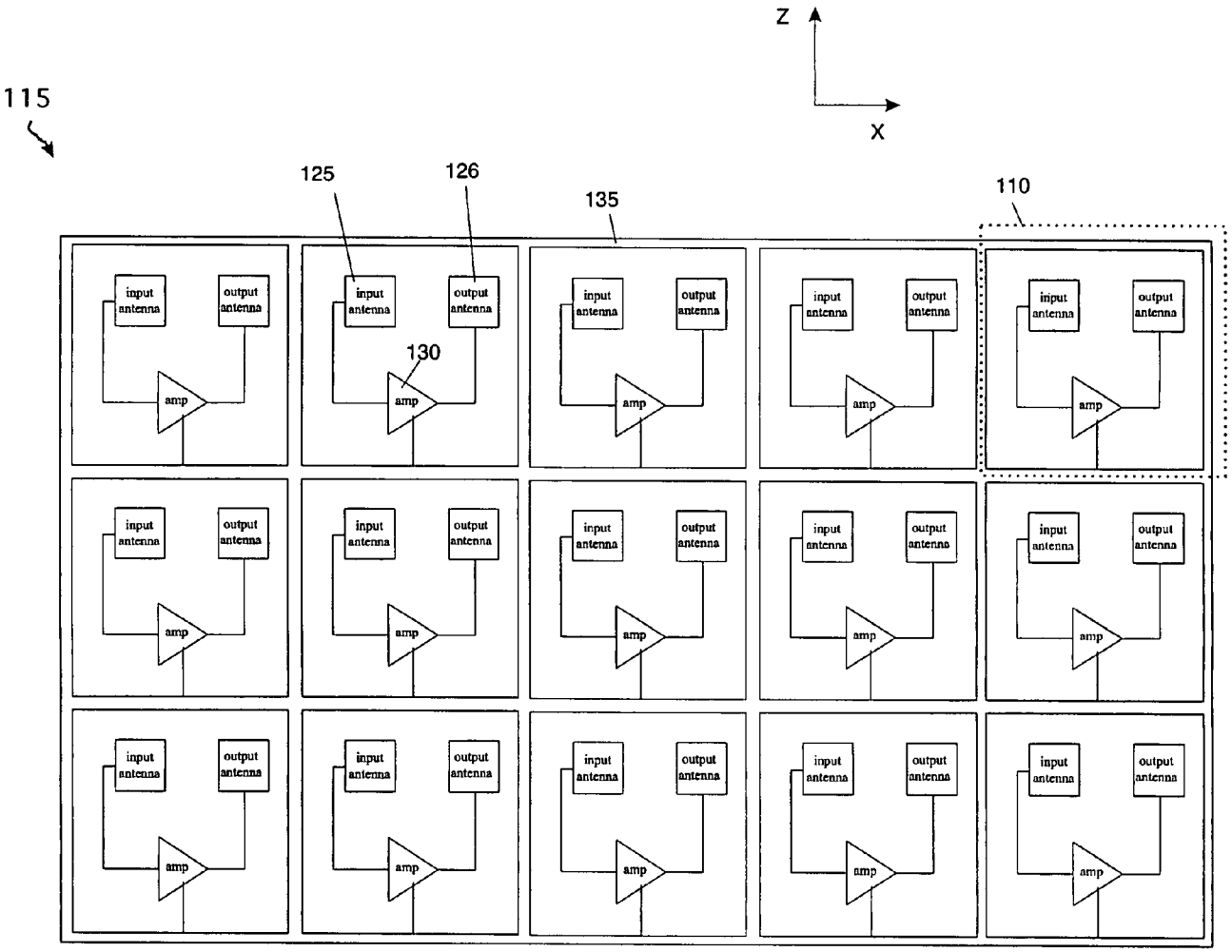
Figure 11:
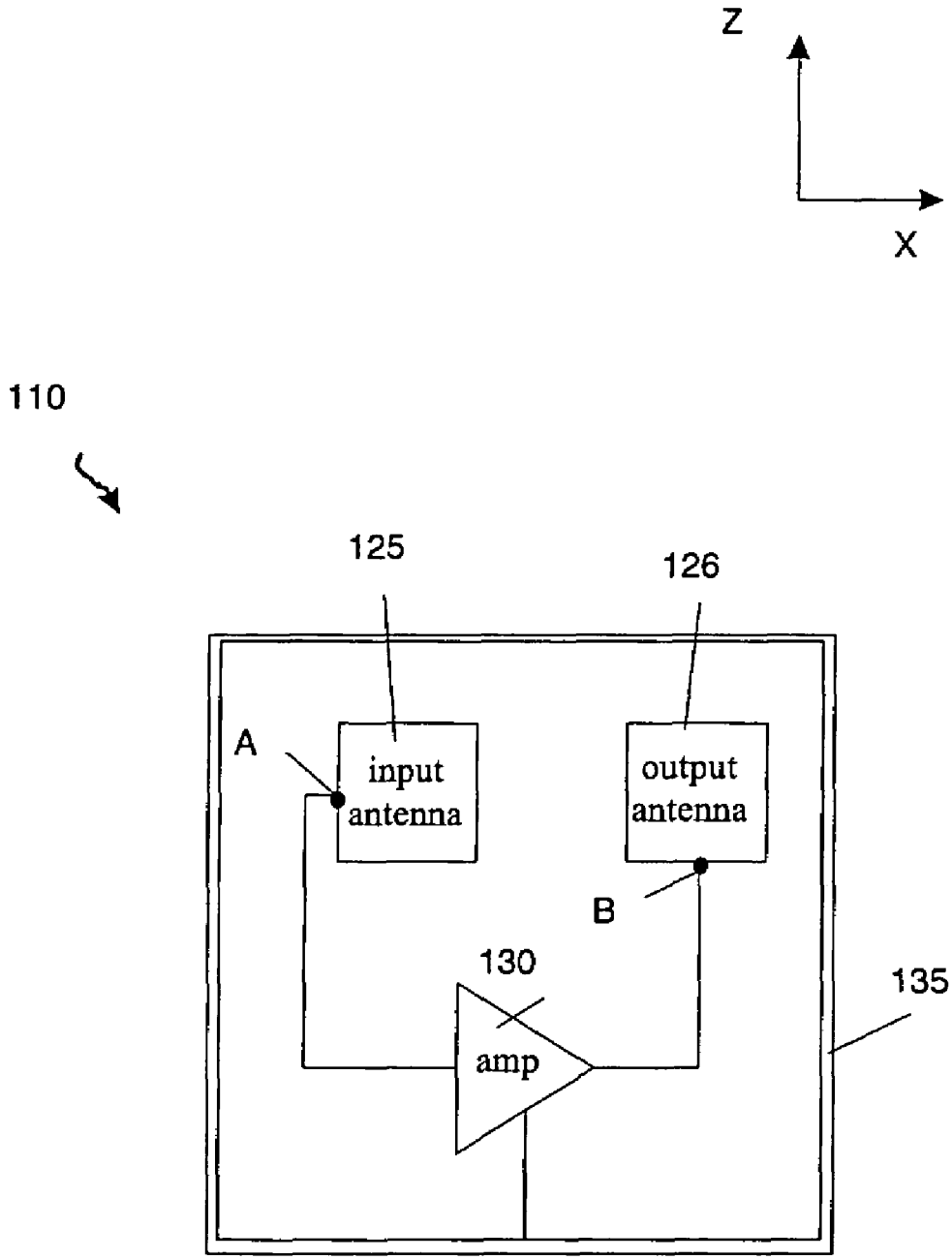
Figure 12:
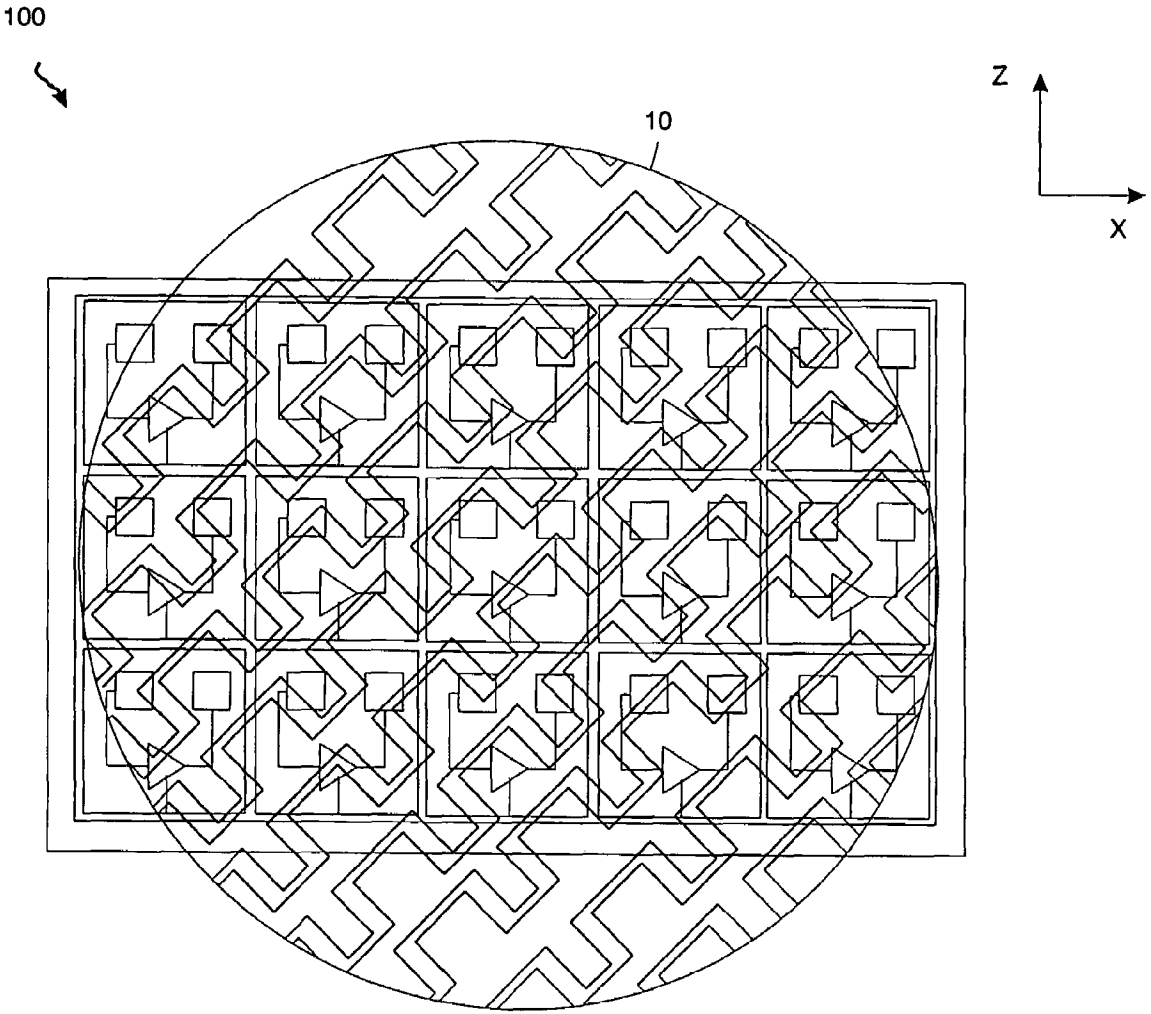
Figure 13A:
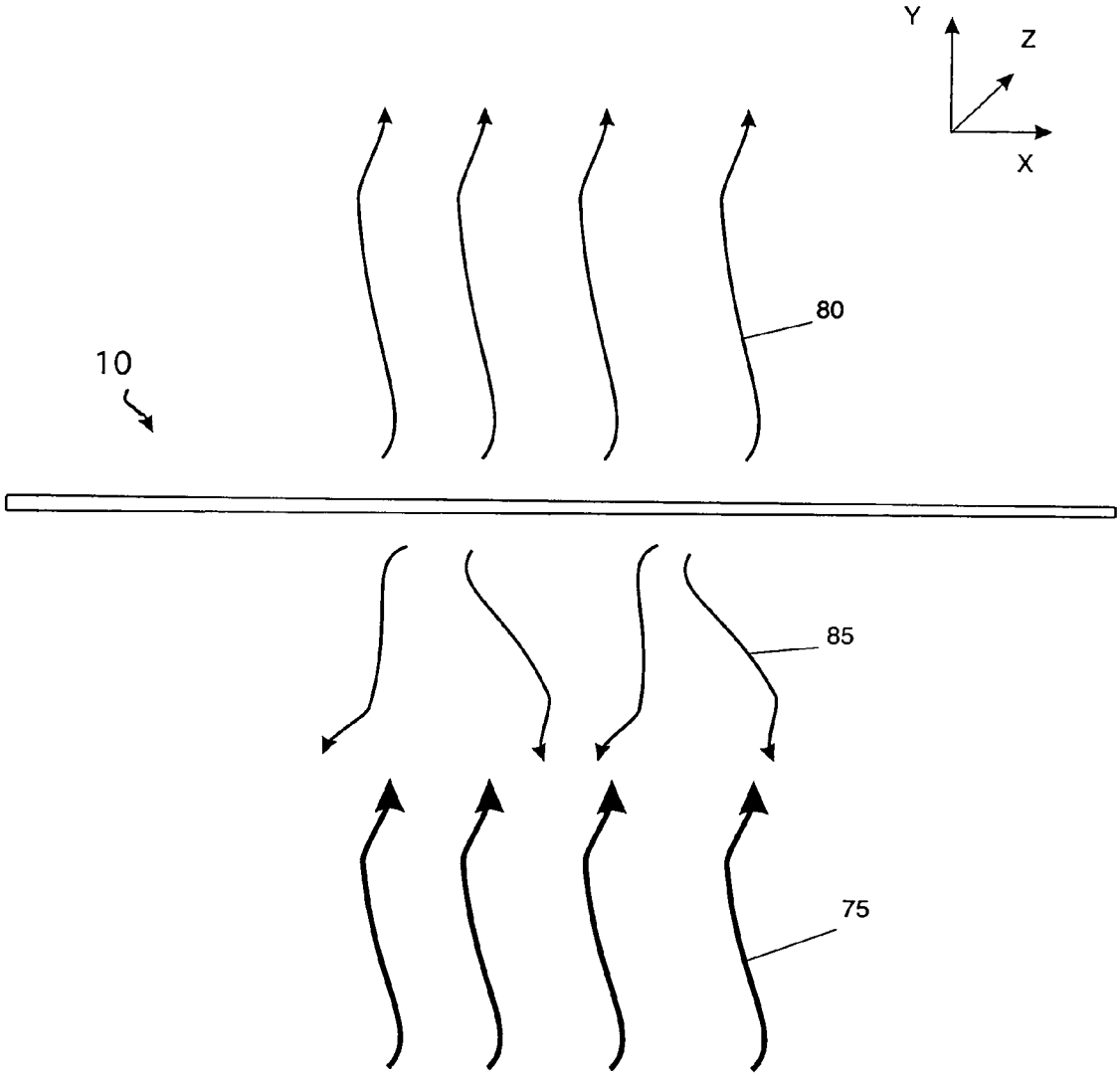
Figure 13B:
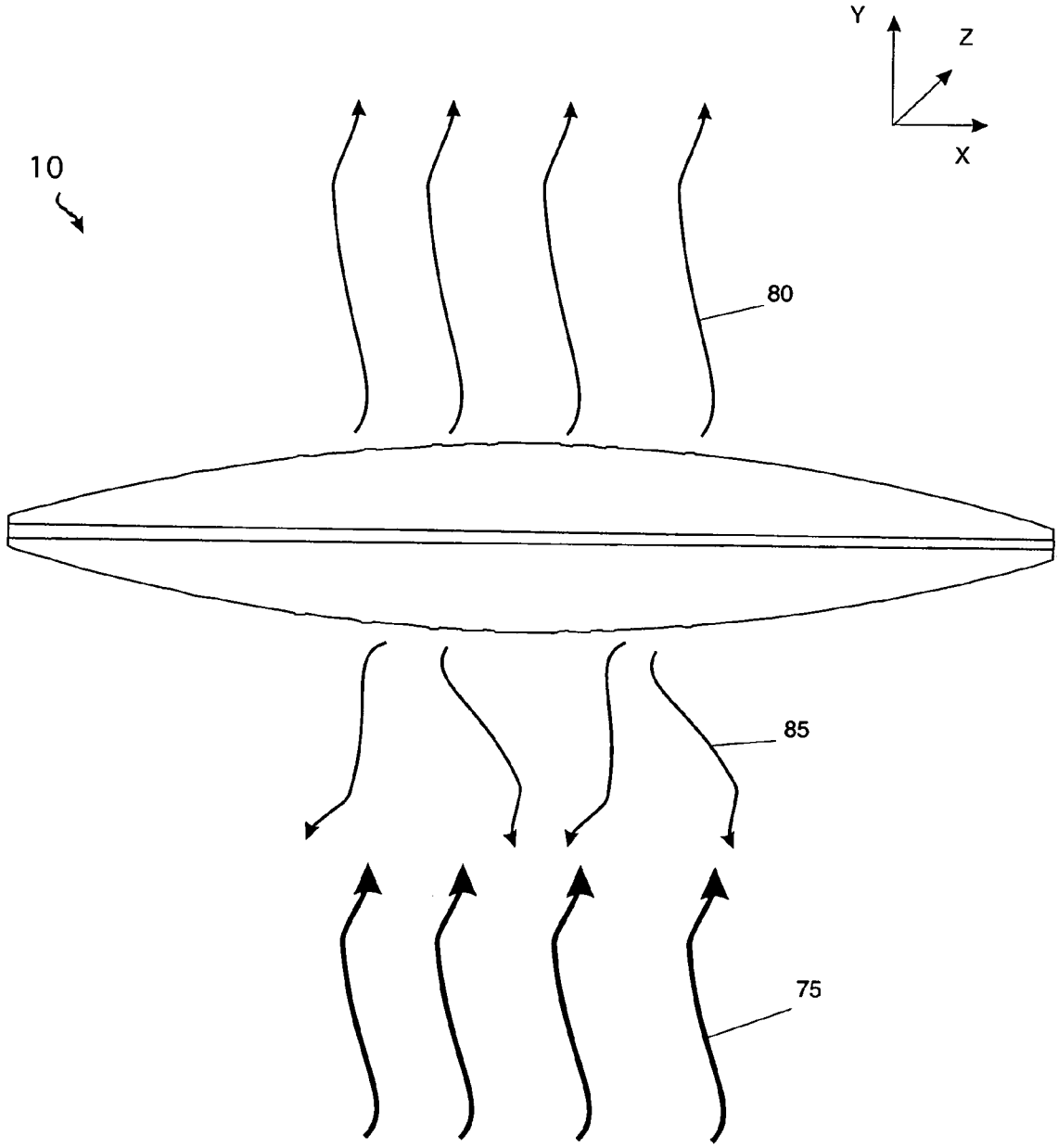
Figure 14:
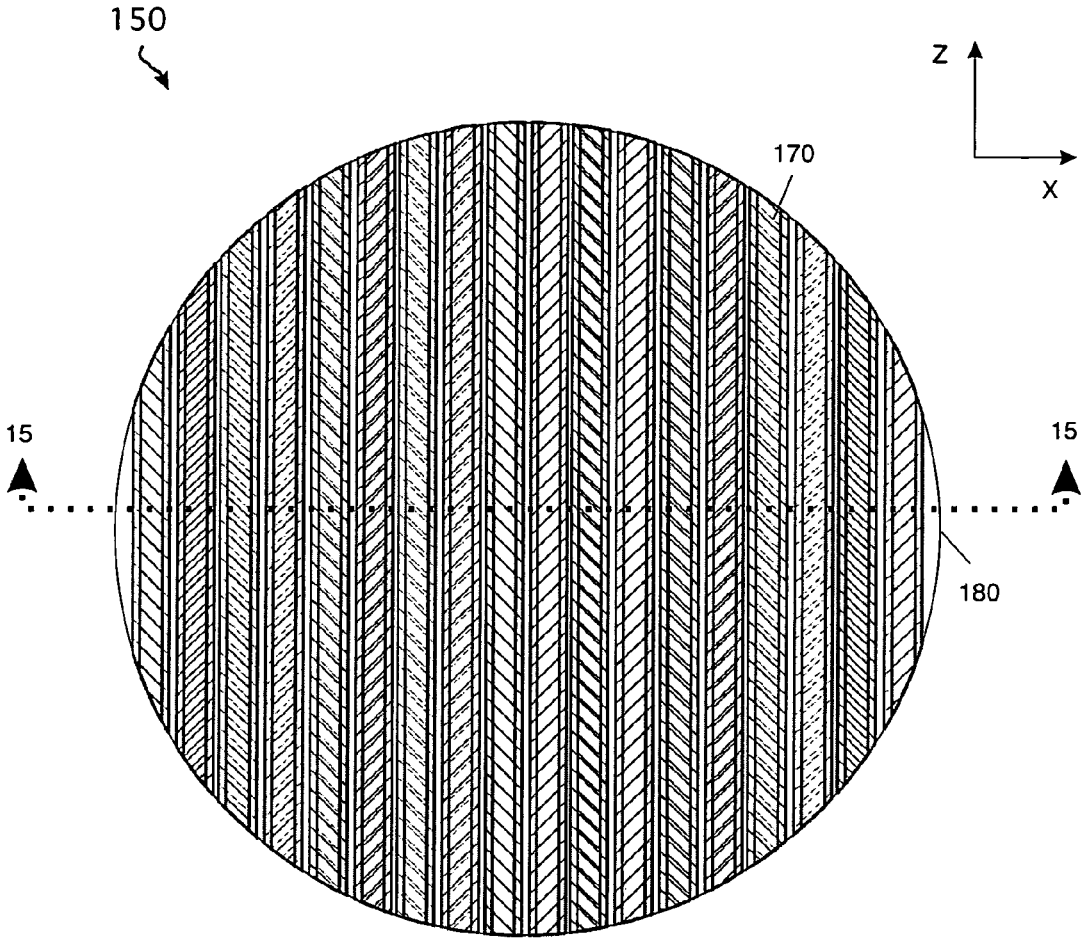
Figure 15A:
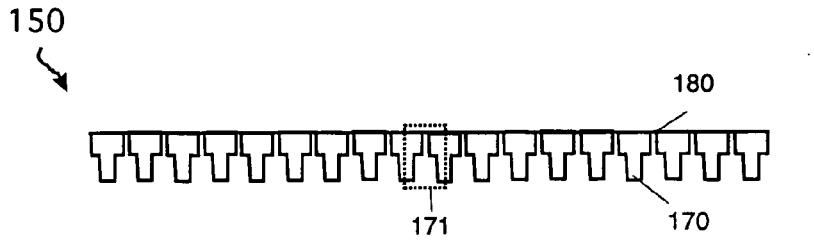
Figure 15B:
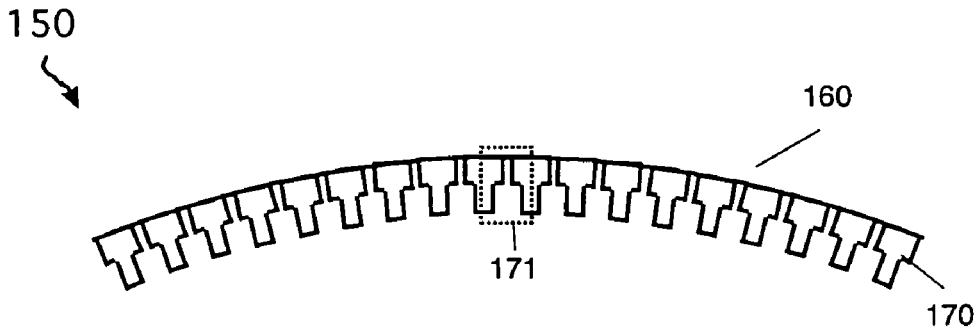
Figure 15C:
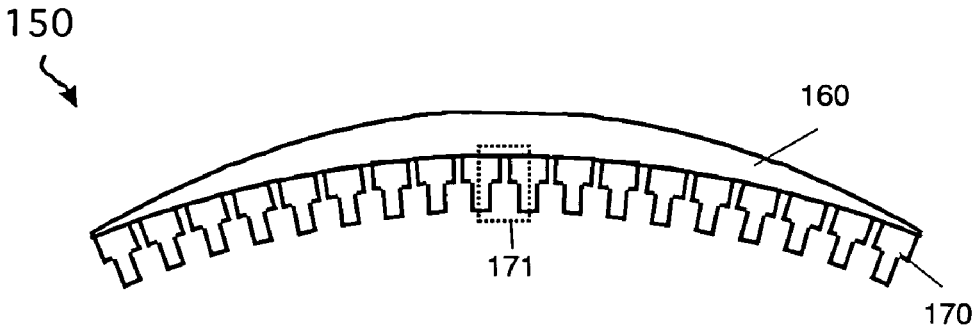
Figure 15D:
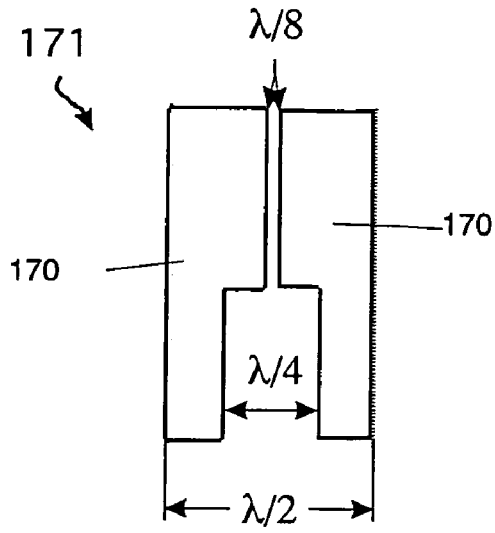
Figure 15E:
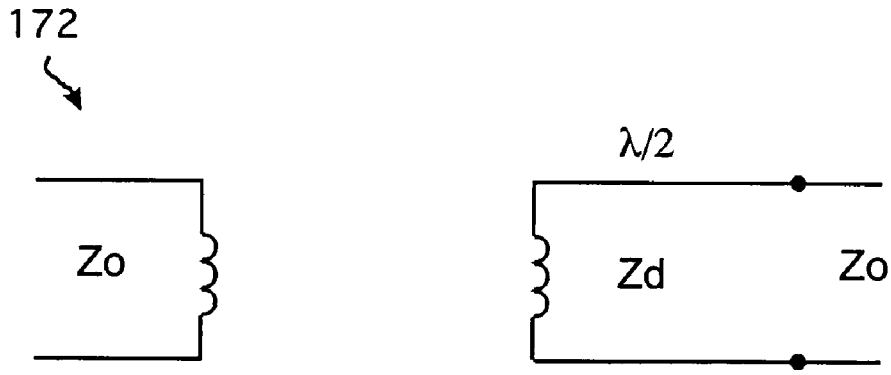
Figure 15F:
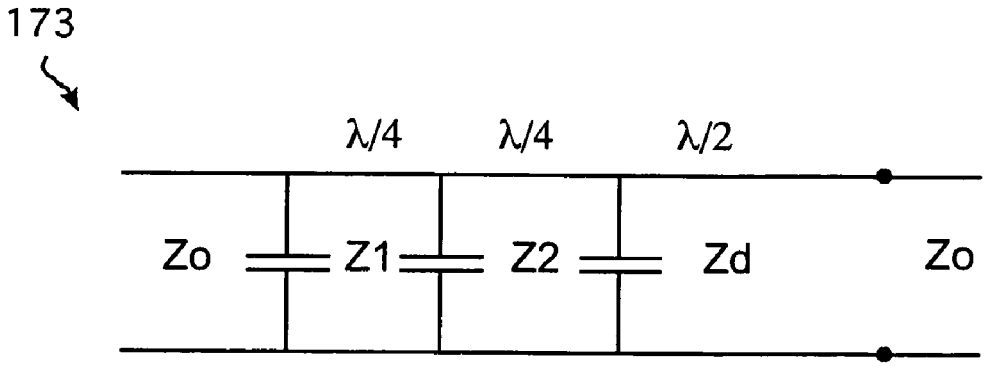
Figure 16A:
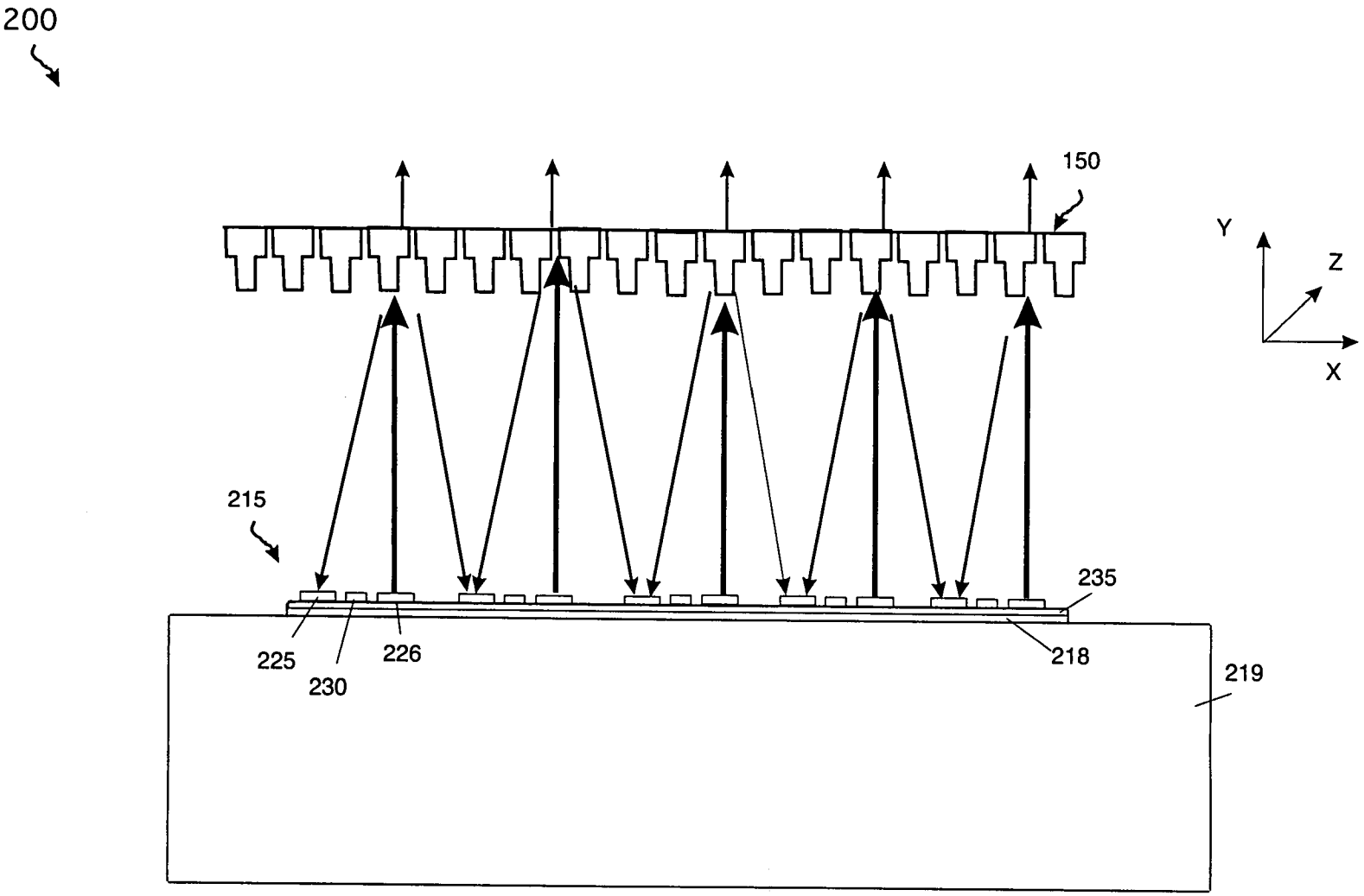
Figure 16B:
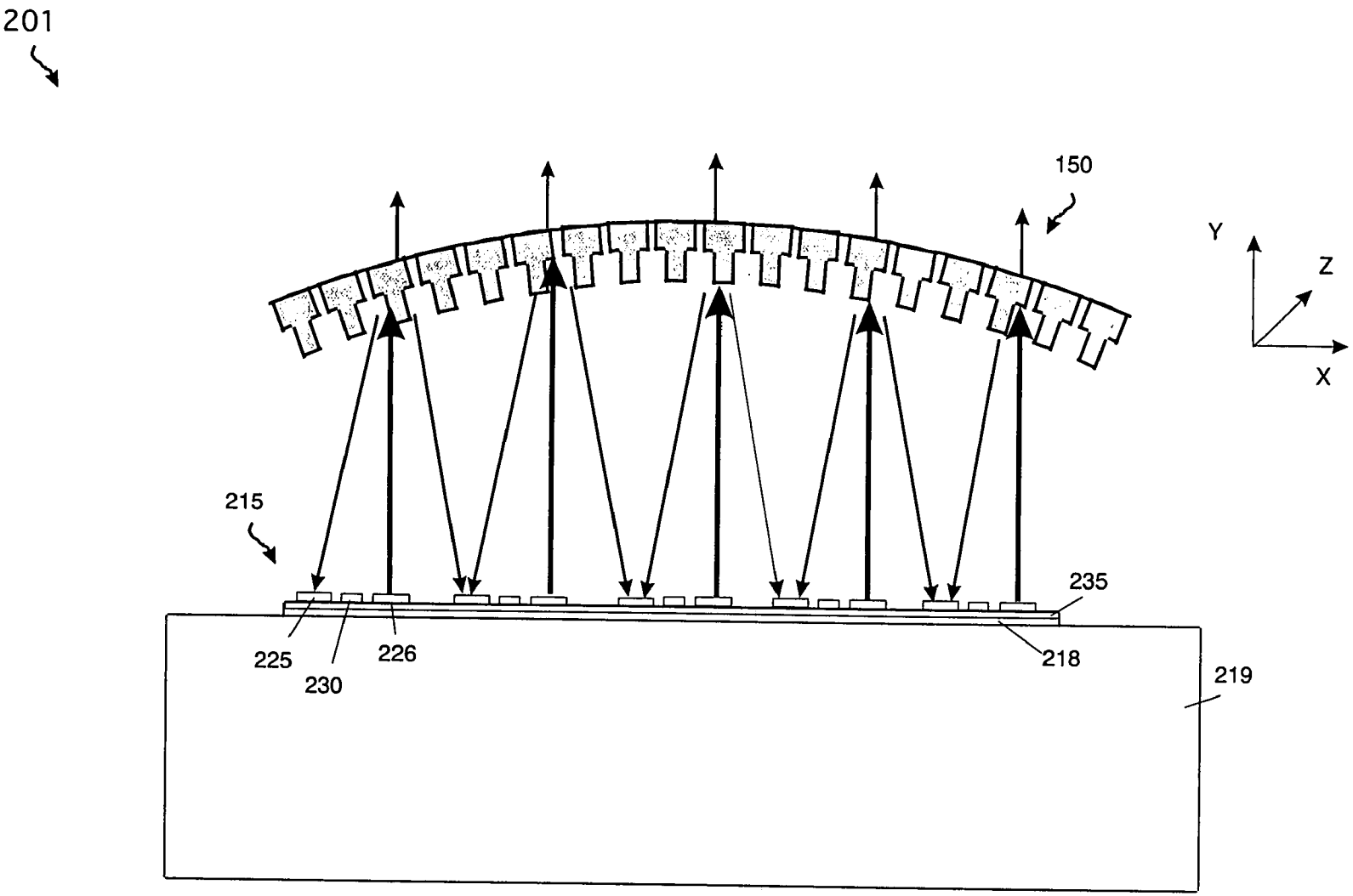
Figure 16C:
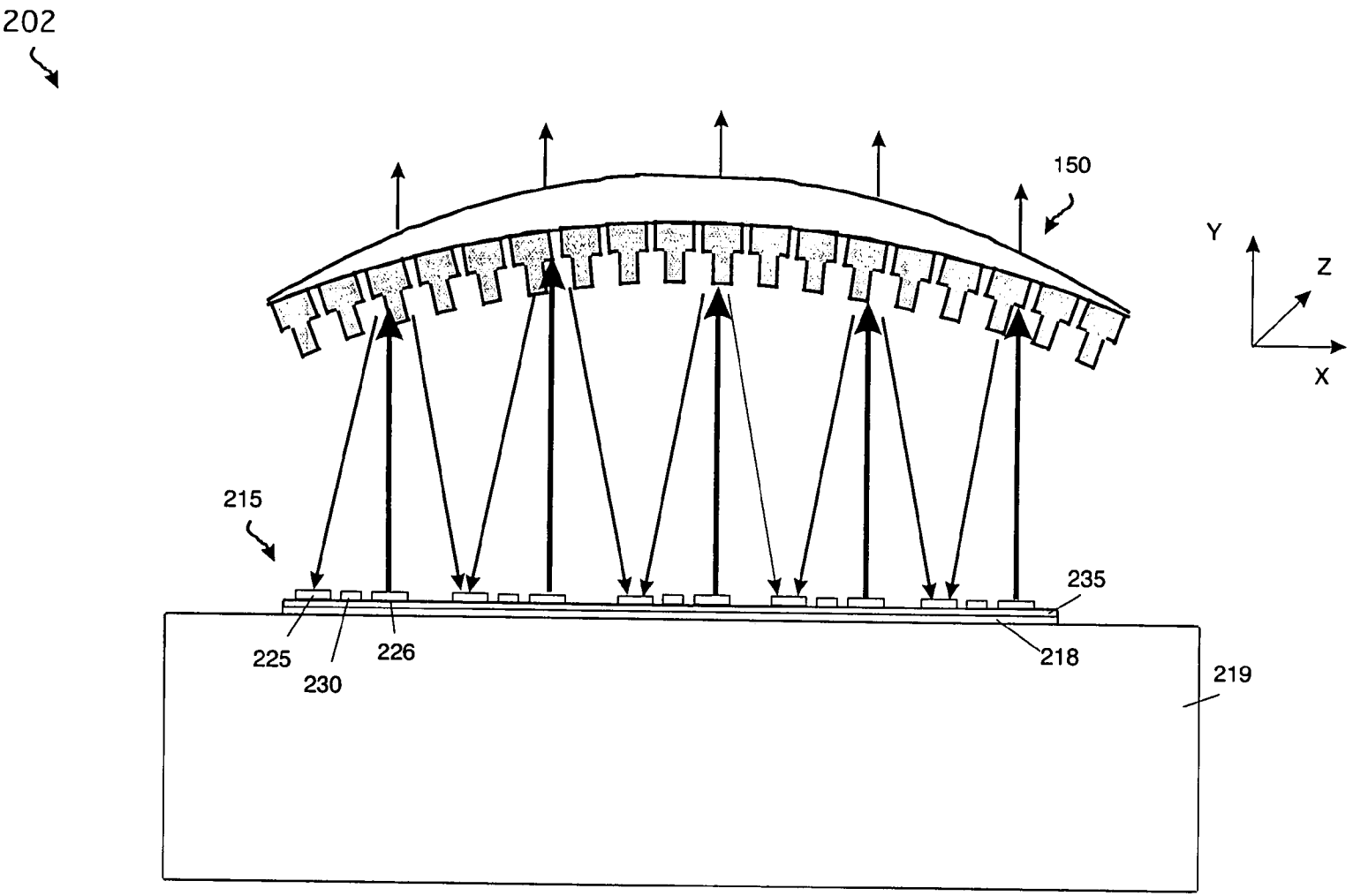
Figure 17:
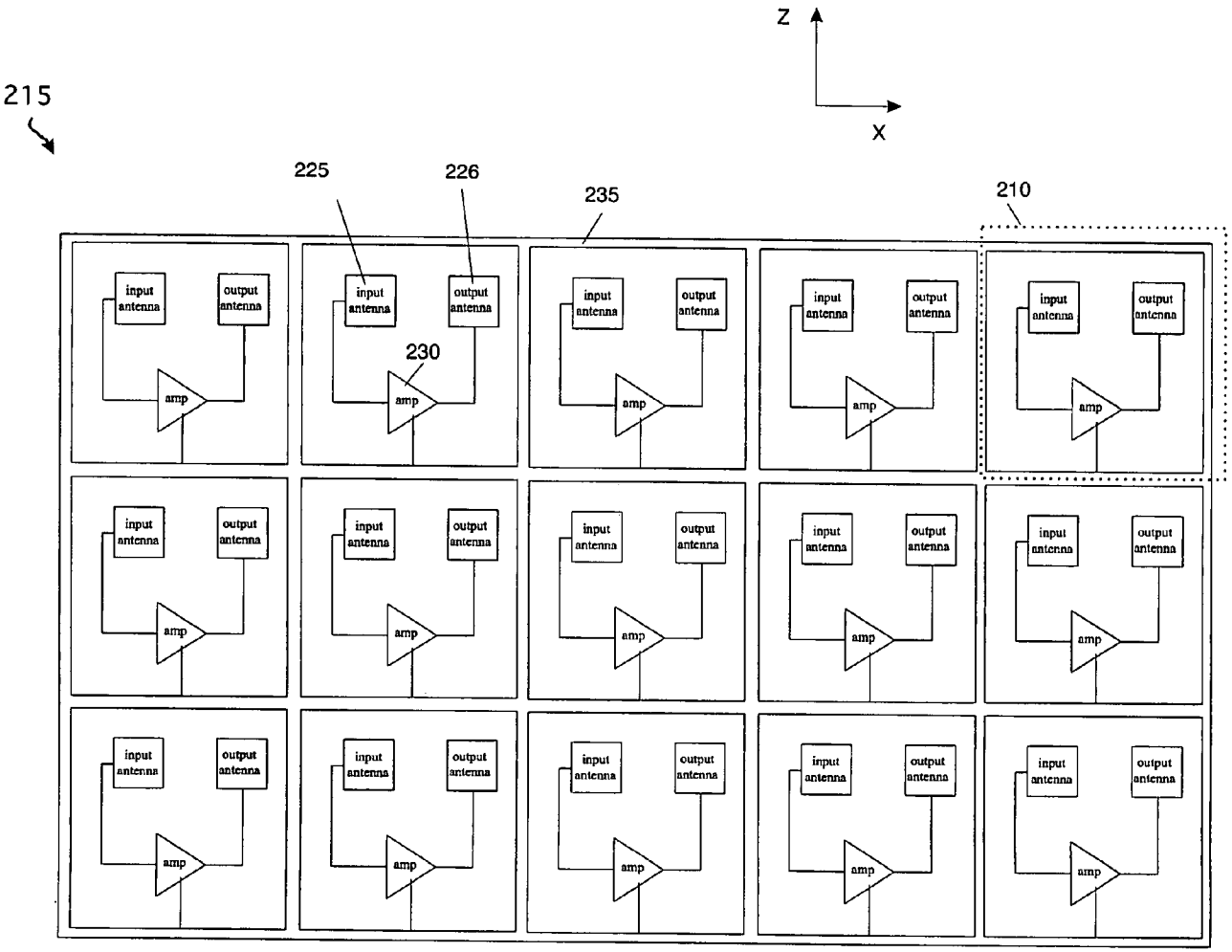
Figure 18:
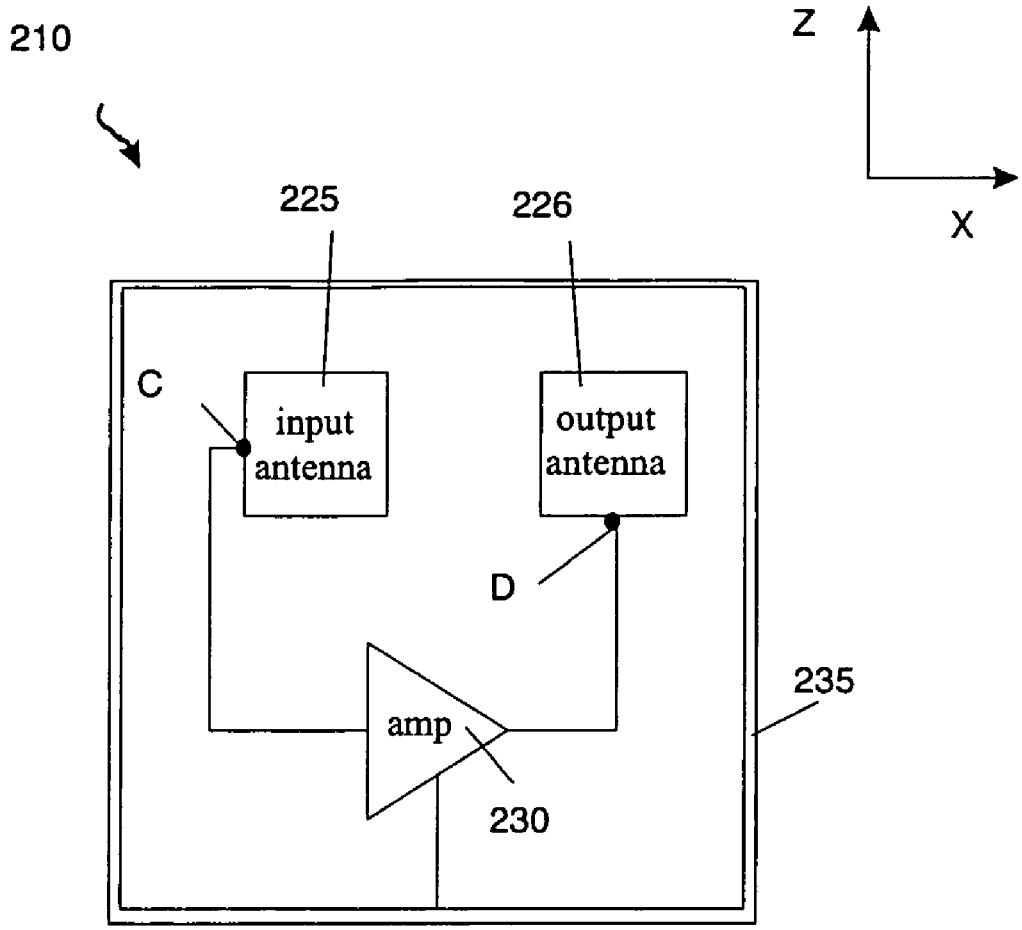
Figure 19:
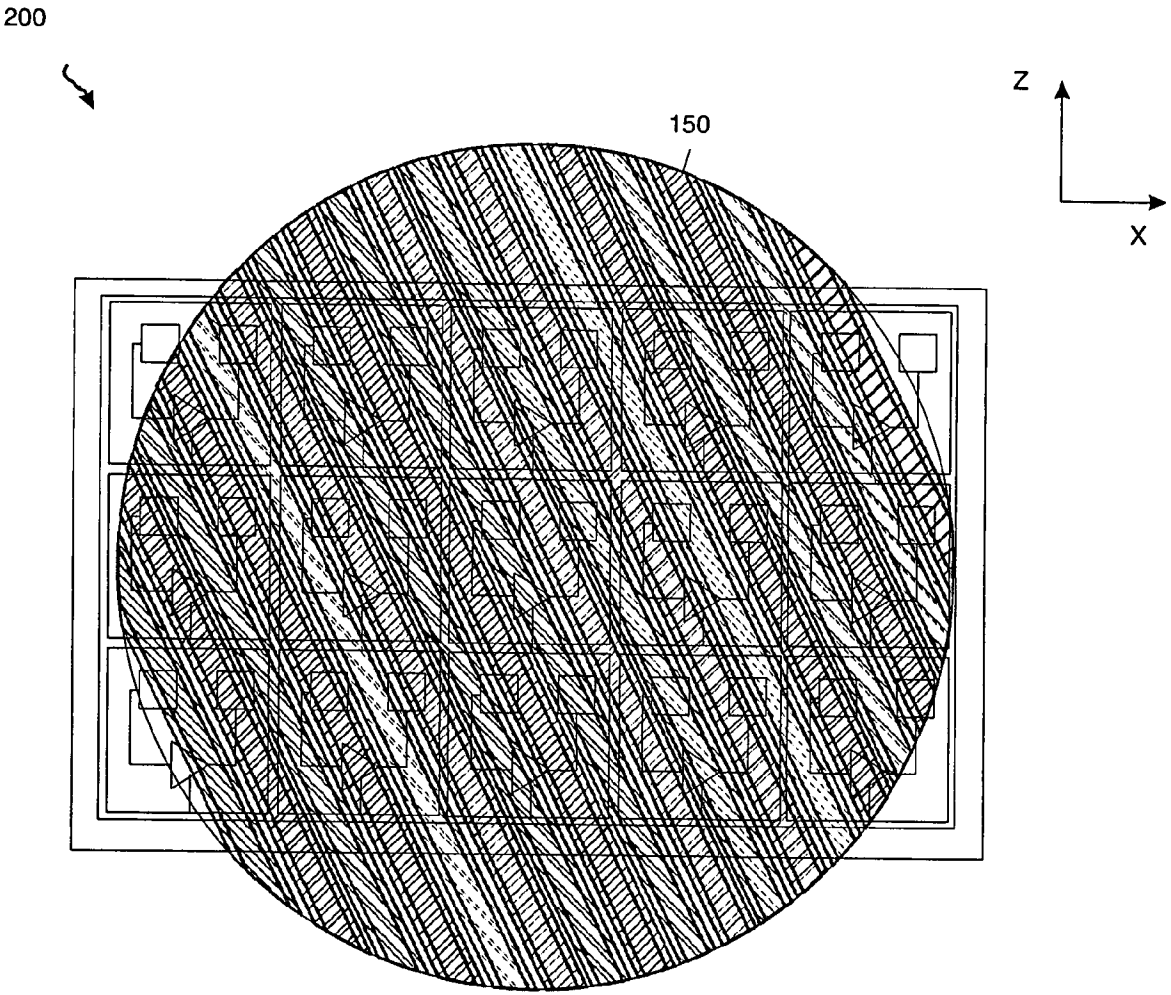

FIG. 8*a* depicts transmission and reflection of incoming RF energy through the FSS structure in FIGS. 2 and 3 in accordance with the present disclosure;

FIG. 8*b* depicts a unit cell of a periodic conductive pattern disposed on the FSS of FIG. 2 in accordance with the present disclosure;

FIG. 8*c* depicts an equivalent circuit for two unit cells depicted in FIG. 8*a* in accordance with the present disclosure;

FIGS. 9*a* and 9*b* depict examples of an oscillator apparatus in accordance with the present disclosure;

FIG. 10 depicts an array of amplification devices in accordance with the present disclosure;

FIG. 11 depicts an amplification device in accordance with the present disclosure;

FIG. 12 depicts a top view of the oscillator apparatus shown in FIG. 9*a* in accordance with the present disclosure;

FIG. 13*a* depicts a structure comprising a frequency selective surface (FSS) operating as a polarization filter in accordance with the present disclosure;

FIG. 13*b* depicts the FSS shown in FIG. 13*a* disposed between two lenses in accordance with the present disclosure;

FIG. 14 depicts a top view of a structure comprising metal ribs in accordance with the present disclosure;

FIGS. 15*a*, 15*b* and 15*c* depict exemplary cross section of the structure shown in FIG. 14 in accordance with the present disclosure;

FIG. 15*d* depicts a unit cell of the metal rib periodic pattern shown in FIGS. 15*a*, 15*b* and 15*c* in accordance with the present disclosure;

FIGS. 15*e* and 15*f* depict equivalent circuits for unit equivalent circuit depicted in FIG. 15*d* in accordance with the present disclosure;

FIGS. 16*a*, 16*b* and 16*c* depict examples of an oscillator apparatus in accordance with the present disclosure;

FIG. 17 depicts an array of amplification devices in accordance with the present disclosure;

FIG. 18 depicts an amplification device in accordance with the present disclosure;

FIG. 19 depicts a top view of the oscillator apparatus shown in FIG. 16*a* in accordance with the present disclosure.

DETAILED DESCRIPTION

The present disclosure provides a method for coupling power into and out of a reflection amplifier array for quasi-optical power combining. The reflection amplifier array offers a simple and versatile method of producing large amounts of power at millimeter wave frequencies. This approach, however, requires that some of the power that is radiated from the array be reflected back to the array in the orthogonal polarization, with the remaining power being radiated away into free space to form the output beam. In addition, it is desired that both the reflected wave and transmitted wave be collimated so that the phases fronts are as flat as possible. The present disclosure describes structures that accomplish this.

Figure 1:
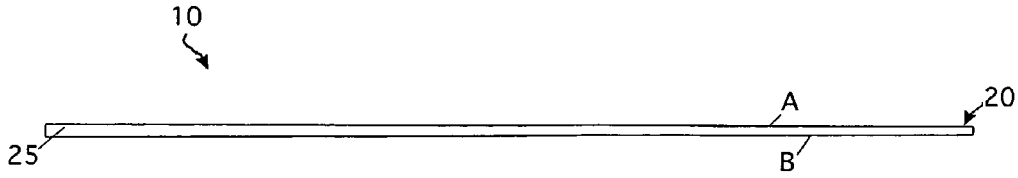
FIG. 1 depicts a side view of a frequency selective surface (FSS) in accordance with the present disclosure.

In one exemplary embodiment, a structure 10 is shown in FIGS. 1-3. The structure 10, as shown in FIGS. 1-3 consists of a frequency selective surface (FSS) 20 having a periodic pattern of conductors 50 and 60 disposed on the surfaces A and B, respectively, of FSS 20. FIG. 1 shows a side view of the structure 10. FIGS. 2 and 3 show a periodic pattern of conductors 50 and 60 disposed on the surfaces A and B, respectively, of FSS 20. Although the periodic pattern of conductors 50 and 60 in this embodiment are aligned so as to be substantially parallel to each other, this is not necessarily a requirement and it shall be understood that other alignments of the periodic pattern of conductors 50 and 60 are possible.

Figure 4:
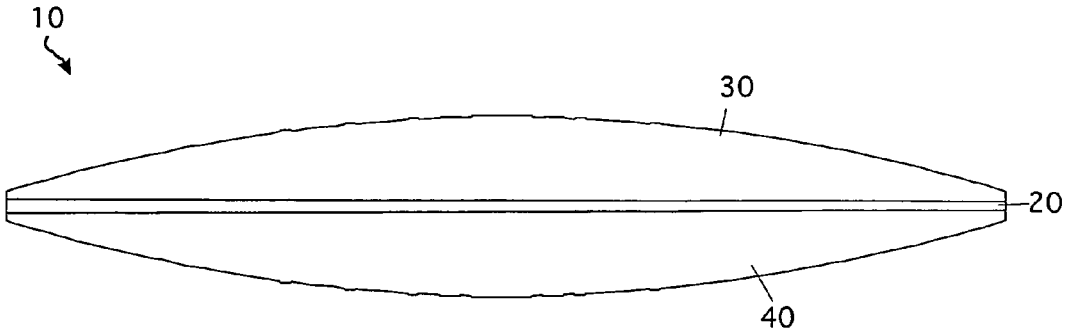
FIGS. 4 and 5 depict the FSS depicted in FIG. 1 disposed between two lenses in accordance with the present disclosure.
Figure 5:
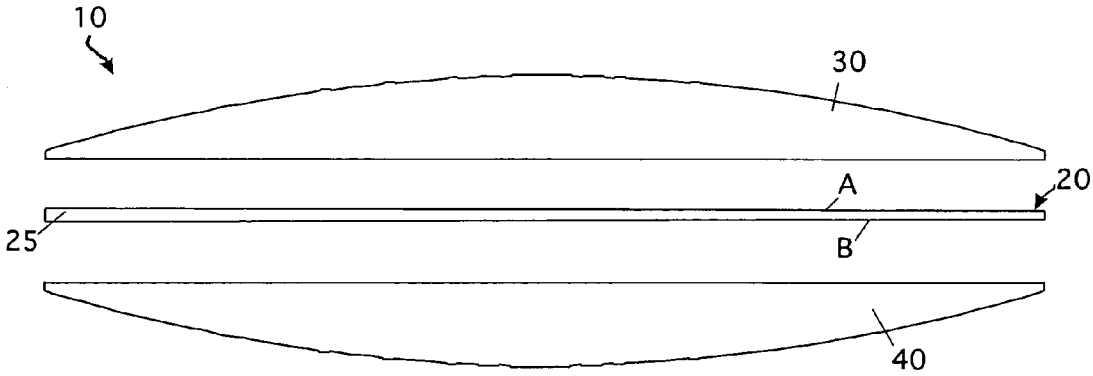
Figure 6:
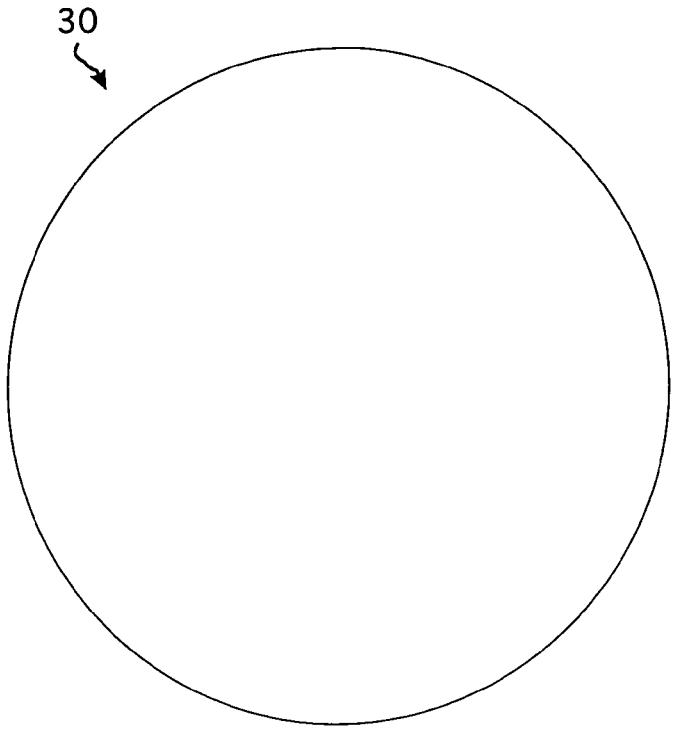
FIGS. 6 and 7 depict top view of the lenses depicted in FIGS. 4 and 5 in accordance with the present disclosure.
Figure 7:
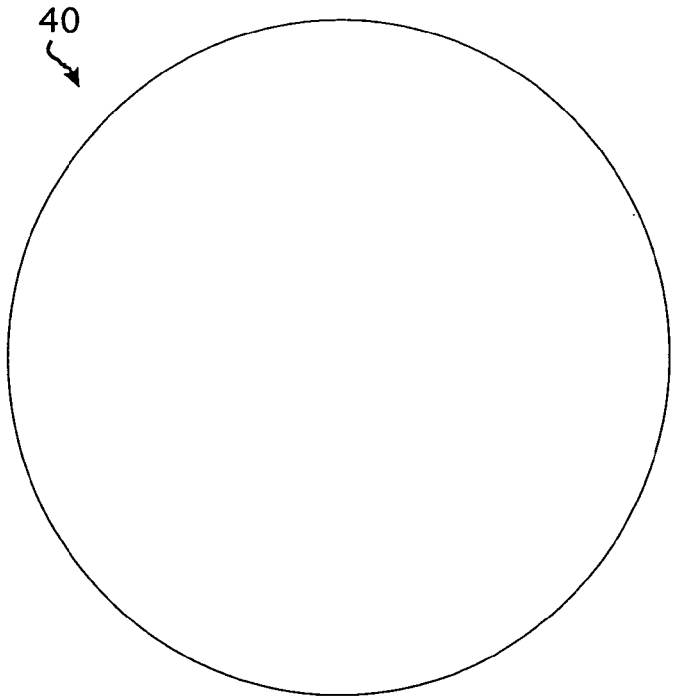

The structure 10 may optionally have the frequency selective surface (FSS) 20 sandwiched between two planar-convex lenses 30 and 40 as shown in FIGS. 4 and 5. FIG. 4 shows a side view of the structure 10 with the lenses 30 and 40 and FIG. 5 shows an exploded side view of the structure 10 with lenses 30 and 40 separated from FSS 20 for clarity reasons. FIGS. 6 and 7 show top view of lenses 30 and 40 respectively.

Referring to FIG. 8*a*, the FSS 20 as depicted in FIGS. 2 and 3 has the following properties at the operating frequency: power in Einput polarization is actually a combination of Einput-z polarization and Einput-x polarization, as shown in FIG. 8*a*. The power Einput-z polarization relative to the periodic pattern of conductors 50 and 60 is partially reflected back with the same polarization and the remainder is transmitted in the same polarization. Similarly, the power Einput-x polarization relative to the periodic pattern of conductors 50 and 60 is partially reflected back with the same polarization, but with a 180 deg phase reversal, and the remainder is transmitted in the same polarization, also with phase reversal. The Einput-z polarization and Einput-x (180 deg. phase shift) polarization combine to form power in Eoutput polarization, as shown in FIG. 8*a*. Hence, only power with Eoutput polarization is reflected and transmitted by the structure 10. This being the case, the energy wave (assumed to be 0 deg polarization) incident on the structure 10 reflects no power back with the same polarization, but reflects only in the orthogonal polarization. In addition, power that is transmitted through the structure 10 is also in the orthogonal polarization.

If the structure 10 contains the two optional planar-convex lenses 30 and 40, the coupling of reflected power is given by $$\frac{1}{1+\left[\frac{n_2}{n_1}\right]^2},$$

where $n_2$ is the index of refraction of substrate 25, and $n_1$ is the index of refraction of the lens 30 or 40. For $n_1=n_2$, structure 10 produces 3 dB coupling.

Although the periodic pattern of conductors 50 and 60 in FIGS. 2 and 3 are represented as crenulated lines, it shall be understood that the periodic pattern of conductors 50 and 60 can have different shapes, including but not limited to structures disclosed in B. A. Munk "Frequency Selective Surface, Theory and Design" Wiley, 2000, for this technology to work. The spacing between the periodic pattern of conductors 50 and 60 may be any where from $$\frac{1}{50}$$

of a wavelength of an incoming RF energy to about $$\frac{1}{2}$$

of the wavelength of an incoming RF energy and the width of the periodic pattern of conductors 50 and 60 may be about $$\frac{1}{8}$$

of a wavelength of an incoming RF energy. It shall be understood that the width of the periodic pattern of conductors 50 and 60 can vary depending on the orientation and pattern of the periodic pattern of conductors 50 and 60. The thickness of substrate 25 can be about $$\frac{1}{4}$$

of a wavelength of an incoming RF energy.

FIG. 8*b* depicts a unit cell 65 of the periodic pattern of conductors 50. The unit cell 65 is about $$\frac{1}{2}$$

of the wavelength of an incoming RF energy in the X and Z dimensions. FIG. 8*c* depicts an equivalent circuit 70 for two unit cells 65 disposed on top of each other on surfaces A and B of substrate 25. The energy wave in vertical polarization gives rise to an inductive shunt susceptance Bver, and the energy wave in the horizontal polarization gives rise to a capacitive shunt susceptance Bhoriz. The optimal values for the shunt susceptances can be derived though:

$$Bhoriz = -Bvert = \frac{1}{377\ \text{Ohms}}\sqrt{n_1^2+n_2^2}.$$

Although the structure 10 in FIGS. 1-7 is represented as circle, it shall be understood that peripheral edge of the structure 10 can have different shapes, including, but not limited to, square and/or rectangular shapes.

The disclosed structure 10 may be used as part of an oscillator 100 shown in FIG. 9*a* and an oscillator 101 shown in FIG. 9*b*. The oscillators 100 and 101 utilize amplification devices 110 with crossed input/output polarizations arranged in an array 115, as depicted in FIGS. 10 and 11. The array 115 may be disposed on a substrate 118, as depicted in FIGS. 9*a* and 9*b*, and the substrate 118 may be disposed in a heatsink 119, again as shown in FIGS. 9*a* and 9*b*. The amplification device 110 depicted in FIGS. 10 and 11 may include, a ground plane (not shown), two patch antennas, namely input antenna 125 and output antenna 126, as well as an amplifier 130, and a bias grid 135 supplying bias voltage to the amplifier 130, as disclosed in more detail in U.S. patent application Ser. No. 10/664,112, filed on Sep. 17, 2003 which is incorporated herein by reference in its entirety. It is to be understood that patch antennas are only used as an example and that radiating elements, like horn, slot, cavity backed slot, cavity backed patch, dipole, can also be used for the disclosed apparatus.

The input antennas 125, as depicted in FIGS. 10 and 11, are polarized in the X direction by outputting the incoming energy at feed point A of the input antennas 125. Hence, only the energy polarized in the X direction will propagate from the input antennas 125 to the amplifiers 130. The output antennas 126, as depicted in FIGS. 10 and 11, are polarized in the Z direction by inputting amplified energy from the amplifiers 130 at feed point B of the output antennas 126. Hence, the output antennas 126 will reradiate the energy polarized in the Z direction.

Although the input antennas 125, depicted in FIGS. 10 and 11, are polarized in the X direction and the output antennas 126, depicted in FIGS. 10 and 11, are polarized in the Z direction, it is to be understood that the input antennas 125 can be polarized in any direction. However, the cross polarization of the input antennas 125 and output antennas 126 reduces parasitic coupling and improves the coupling control as will become evident below.

The structure 10 utilized by the oscillators 100 and 101, as depicted in FIGS. 9*a* and 9*b*, provides a mechanism to reflect a specific amount of power back towards the array 115 but in the orthogonal polarization so as to couple the input antennas 125 and output antennas 126, as shown in FIGS. 9*a* and 9*b*. The power that is not reflected is radiated through the structure 10 to form an output beam that is also polarized in the Z direction, as shown in FIGS. 9*a* and 9*b*. To ensure that power from amplifiers is utilized with maximum efficiency the structure 10 mostly reflects and transmits power that is orthogonal to the power transmitted by the output antennas 126. The structure 10 also is able to collimate the reflected energy to create a narrow transmitted beam of energy with minimal diffraction. The ability of the structure 10 to collimate is important because it couples the oscillating elements in a way that produces in-phase oscillation and improves power combining efficiency.

Although there may be extraneous non-orthogonal reflection off of the lenses 30 and 40 due to transition between the lenses and air, the non-orthogonal reflections are minimal and may be even further minimized by coating the lenses 30 and 40 with a coating (not shown) that is about $$\frac{1}{4}$$

of a wavelength of an incoming RF energy in thickness and has an index of refraction that may be about $\sqrt{n}$ where n is an index of refraction of the lens 30 or 40.

The oscillators 100 and 101 may operate without any external power supply as shown in FIGS. 9*a* and 9*b*. Any electrical noise in the oscillators 100 and 101 is amplified by the amplifier 130 and supplied to the output antennas 126. The output antennas 126 output the energy which reflects off of the structure 10, is absorbed by the input antennas 125 causing the oscillators 100 and 101 to operate as an oscillator.

FIG. 12 depicts top view of the oscillator 100. In FIG. 12 the structure 10 is depicted as being translucent in order to show the array 115 of amplification devices 110 below; however, it should be understood that the structure 10 may well be opaque and is only shown as being translucent to help depict its overall relation to the underlying structure.

The structure 10 and the array 115 shown in FIG. 12 and the amplification device 110 shown in FIG. 11 are not drawn to scale. The diameter of the structure 10 may be twice the width of the array 115 and the size of the amplification device 110 may be about $$\frac{1}{2}$$

of a wavelength of an incoming RF energy.

Referring to FIGS. 13*a* and 13*b*, the structure 10 may further operate as a polarization filter for transmitting energy 80 that is cross-polarized to the input energy 75. The part of the input energy 75 polarized in the X direction would be reflected back 85 in the Z polarization while the remaining energy 80 will propagate through the structure 10 also in the Z polarization.

In another exemplary embodiment, a structure 150 is shown in FIG. 14. The structure 150, as shown in FIGS. 14 and 15 consists of metal ribs 170 attached to, for example, a frame 180. FIG. 14 shows a bottom view of metal ribs 170 held together by a frame 180.

FIGS. 15*a* and 15*b* depict possible exemplary cross sections of the structure 150 along the line 15. FIG. 15*a* depicts a cross section wherein the metal ribs 170 are disposed in a straight line and FIG. 15*b* depicts a cross section wherein the metal ribs 170 are disposed having a parabolic curvature. The structure 150 shown in FIG. 15*b* may optionally contain a lens 160 as shown in FIG. 15*c*.

The metal ribs 170 as depicted in FIGS. 14 and 15*a-c* have the following properties at the operating frequency: power incident with about +45 degrees polarization with respect to the metal ribs 170 is partially reflected back from the metal ribs 170 with the same polarization and the remainder is transmitted through the slots between the metal ribs 170 in the same polarization. Similarly, power incident with about −45 degrees polarization with respect to the metal ribs 170 is partially reflected back from the metal ribs 170 with the same polarization, but with a 180 deg phase reversal, and the remainder is transmitted through the slots between the metal ribs 170 with the same polarization, also with phase reversal. This being the case, the energy wave (assumed to be 0 deg polarization) incident on the metal ribs 170 reflects no power back in the same polarization, but reflects only in the orthogonal polarization. In addition, power that is transmitted through the slots between the metal ribs 170 is also in the orthogonal polarization. The collimation of the transmitted wave is accomplished with the lens 160 shown in FIG. 14. Collimation of the reflected wave is accomplished by the parabolic curvature of the metallic side of the structure.

FIG. 15*d* depicts a unit cell 171 of the metal ribs 170. The centers of the metal ribs 170 in the unit cell 171 may be about $$\frac{1}{2}$$

of the wavelength of an incoming RF energy away from each other. The widest gap between the metal ribs 170 in the unit cell 171 may be about $$\frac{1}{4}$$

of the wavelength of an incoming RF energy. The smallest gap between the metal ribs 170 in the unit cell 171 may be about $$\frac{1}{8}$$

of the wavelength of an incoming RF energy. FIGS. 15*e* and 15*f* depict equivalent circuits 172, 173, respectively, for the unit cell 171. The energy wave in horizontal polarization gives rise to an inductive shunt susceptance as shown in FIG. 15*e*, and the energy wave in the vertical polarization gives rise to a capacitive shunt susceptance as shown in FIG. 15*f*.

Although the metal ribs 170 in FIGS. 14-15*d* are T-shaped, it shall be understood other rib shapes that are straight, rounded or flared may also be implemented.

Although the structure 150 in FIGS. 14-15*c* is represented as circle, it shall be understood that the peripheral edge of the structure 150 can have different shapes, including, but not limited to, square and/or rectangular shapes.

The disclosed structure 150 may be used as part of an oscillator 200, 201 and 202 shown in FIGS. 16*a-c*. The oscillators 200, 201, 202 utilize amplification devices 210 with crossed input/output polarizations arranged in an array 215, as depicted in FIGS. 17 and 18. The array 215 may be disposed on a substrate 218, as depicted in FIGS. 16*a-c*. The substrate 218 may be disposed in a heatsink 219, as shown in FIGS. 16*a-c*. The amplification device 210 depicted in FIGS. 17 and 18 may include a ground plane (not shown), two patch antennas, namely input antenna 225 and output antenna 226, as well as an amplifier 230, and a bias grid 235 supplying bias voltage to the amplifier 230, as disclosed in more detail in U.S. patent application Ser. No. 10/664,112, filed on Sep. 17, 2003, which is incorporated herein by reference in its entirety. It is to be understood that patch antennas are only used as an example and that radiating elements, like horn, slot, cavity backed slot, cavity backed patch, dipole, can also be used for the disclosed apparatus.

The input antennas 225, as depicted in FIGS. 17 and 18, are polarized in the X direction by outputting the incoming energy at feed point C of the input antennas 225. Hence, only the energy polarized in the X direction will propagate from the input antennas 225 to the amplifiers 230. The output antennas 226, as depicted in FIGS. 17 and 18, are polarized in the Z direction by inputting amplified energy from the amplifiers 230 at feed point D of the output antennas 226. Hence, the output antennas 226 will reradiate the energy polarized in the Z direction.

Although the input antennas 225, depicted in FIGS. 17 and 18, are polarized in the X direction and the output antennas 226, depicted in FIGS. 17 and 18, are polarized in the Z direction, it is to be understood that the input antennas 225 can be polarized in any direction. However, the cross polarization of the input antennas 225 and output antennas 226 reduces parasitic coupling and improves the coupling control as will become evident below.

The structure 150 utilized by oscillators 200, 201, 202, as depicted in FIGS. 16*a-c*, provides a mechanism to reflect some power back towards the array 215 but in the orthogonal polarization so as to couple the input antennas 225 and output antennas 226, as shown in FIGS. 16*a-c*. The power that is not reflected is radiated through the structure 150 to form an output beam that is also polarized in the Z direction, as shown in FIGS. 16*a-c*. To ensure that power from amplifiers is utilized with maximum efficiency the structure 150 mostly reflects and transmits power that is orthogonal to the power transmitted by the output antennas 226.

Although there may be extraneous non-orthogonal reflection off of the lens 160 due to transition between the lens and air, the non-orthogonal reflections are minimal and may be even further minimized by coating the lens 160 with a coating (not shown) that is about $$\frac{1}{4}$$

of a wavelength in thickness and has an index of refraction that may be about $\sqrt{n}$ where n is an index of refraction of the lens 160.

The oscillators 200, 201, 202 may operate without any external power supply as shown in FIGS. 16*a-c*. Any electrical noise in the oscillators 200, 201, 202 is amplified by the amplifier 230 and supplied to the output antennas 226. The output antennas 226 output the energy which reflects off of the structure 150, is absorbed by the input antennas 225 causing the oscillator 200 to operates as an oscillator.

FIG. 19 depicts top view of the oscillator 200. In FIG. 19 the structure 150 is depicted as being translucent in order to show the array 215 of amplification devices 210 below; however, it should be understood that the structure 150 may well be opaque and is only shown as being translucent to help depict its overall relation to the underlying structure.

The structure 150 and the array 215 shown in FIG. 19 and the amplification device 210 shown in FIG. 18 are not drawn to scale. The diameter of the structure 150 may be twice the width of the array 215 and the size of the amplification device 210 may be about $$\frac{1}{2}$$

of a wavelength of an incoming RF energy.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. A structure comprising:

a substrate with a first and a second major surfaces;

a first plurality of conductors arranged in a first pattern on the first major surface; and a second plurality of conductors arranged in a second pattern on the second major surface at a first angle to said first plurality of conductors to reflect and transmit incoming RF energy in cross polarization to a polarization of said incoming RF energy, wherein at least one of the conductors extends from an edge to an opposite edge of the substrate.

2. The structure as claimed in claim 1, further comprising:

a first planar-convex lens disposed on the first major surface of said substrate; and a second planar-convex lens disposed on the second major surface of said substrate.

3. The structure as claimed in claim 1, wherein said first angle is zero degrees.

4. The structure as claimed in claim 1, wherein the first plurality of conductors are crenulated.

5. The structure as claimed in claim 1, wherein the second plurality of conductors are crenulated.

6. The structure as claimed in claim 2, wherein said first and second planar-convex lenses are circularly shaped.

7. The structure as claimed in claim 6, wherein said substrate is circularly shaped.

8. The structure as claimed in claim 2, wherein said first and second planar-convex lenses are rectangular.

9. The structure as claimed in claim 8, wherein said substrate is rectangular.

10. The structure as claimed in claim 1, further comprising a plurality of active amplification devices, wherein input of each active amplification device is cross polarized with respect to its output, wherein the plurality of active amplification devices are disposed in spaced relation with the substrate.

11. A structure comprising:

a plurality of metal ribs adapted to reflect and transmit an incoming RF energy in cross polarization to a polarization of said incoming RF energy, wherein at least one of the metal ribs extends from an edge to an opposite edge of the structure.

12. The structure as claimed in claim 11, further comprising a convex lens being supported by the plurality of metal ribs.

13. The structure as claimed in claim 11, wherein said plurality of metal ribs are convex shape.

14. The structure as claimed in claim 11, further comprising a plurality of active amplification devices, wherein input of each active amplification device is cross polarized with respect to its output, wherein the plurality of active amplification devices are disposed in spaced relation with the metal ribs.

15. A method for manufacturing an oscillator, said method comprising:

selecting a plurality of active amplification devices, wherein input of each active amplification device is cross polarized with respect to its output;

selecting a structure comprising a substrate with a first and a second major surfaces;

a first plurality of conductors arranged in a first pattern on the first major surface;

a second plurality of conductors arranged in a second pattern on the second major surface at a first angle to said first plurality of conductors;

disposing the plurality of active amplification devices in an array; and disposing the structure in a spaced relation with the plurality of active amplification devices so as to couple cross polarized input and output of each active amplification device.

16. The method as claimed in claim 15, further comprising:

selecting a first planar-convex lens;

arranging the first planar-convex lens on the first major surface;

selecting a second planar-convex lens; and arranging the second planar-convex lens on the second major surface.

17. The method as claimed in claim 15, wherein said first and said second plurality of periodic pattern of conductors are crenulated.

18. The method as claimed in claim 17, wherein the conductors are about ⅛ of a wavelength in width.

19. The method as claimed in claim 17, wherein the conductors are about 1/50 to about ½ of a wavelength apart.

20. The method as claimed in claim 15, wherein said first and said second plurality of periodic pattern of conductors are disposed at an angle with the input of each active amplification device.

21. The method as claimed in claim 15, wherein said angle is in a range of about 40° to 50°.

22. The method as claimed in claim 15, further comprising:

selecting a heatsink with a major surface; and arranging said plurality of active amplification devices on the major surface of the heatsink.

23. The method as claimed in claim 15, wherein energy waves reflect off of said periodic pattern of conductors into the inputs of each active amplification devices and after amplification are at least partially reradiated in a crossed polarization from the output of each active amplification device through said structure.

* * * * *